US009308766B2

(12) United States Patent
Sasamoto et al.

(10) Patent No.: US 9,308,766 B2
(45) Date of Patent: Apr. 12, 2016

(54) HOT-MELT ADHESIVE TEMPERATURE CONTROL METHOD, APPLICATOR THEREFOR, AND BOOKBINDING APPARATUS

(75) Inventors: Shinya Sasamoto, Hokuto (JP); Atsushi Tsuchiya, Minami Alps (JP)

(73) Assignee: Nisca Corporation, Minamikoma-gun (JP)

( * ) Notice: Subject to any disclaimer, the term of this patent is extended or adjusted under 35 U.S.C. 154(b) by 2823 days.

(21) Appl. No.: 11/676,510

(22) Filed: Feb. 19, 2007

(65) Prior Publication Data

US 2007/0193511 A1 Aug. 23, 2007

(30) Foreign Application Priority Data

Feb. 17, 2006 (JP) ..... 2006-040077

(51) Int. Cl.

| | |
|---|---|
| ***H05B 1/02*** | (2006.01) |
| ***B05C 11/00*** | (2006.01) |
| ***B42C 9/00*** | (2006.01) |
| ***B42C 11/02*** | (2006.01) |
| *B05C 1/00* | (2006.01) |

(52) U.S. Cl.

CPC ..... *B42C 9/0018* (2013.01); *B42C 11/02* (2013.01); *B05C 1/006* (2013.01); *Y10T 156/1798* (2015.01)

(58) Field of Classification Search

USPC ..... 219/221, 481–487, 494, 497, 501; 412/32; 222/189.06, 146.5, 189.11

See application file for complete search history.

(56) References Cited

U.S. PATENT DOCUMENTS

| | | | | |
|---|---|---|---|---|
| 2004/0173142 | A1* | 9/2004 | Willis | 117/200 |
| 2004/0194894 | A1* | 10/2004 | Takagi et al. | 156/546 |
| 2006/0018734 | A1* | 1/2006 | Nagaya et al. | 412/37 |

* cited by examiner

*Primary Examiner* — Brian Jennison

(74) *Attorney, Agent, or Firm* — James W. Judge

(57) ABSTRACT

Bookbinding apparatus adhesive applicator accurately, briefly controls adhesive temperature to a set value by selecting, in accordance with adhesive initial temperature, one of a plurality of temperature-controller heating modes defining different supply powers and supply durations for supplying power to an adhesive-container heater to control its heating temperature. A sensor detects the temperature of the adhesive in the container at applicator start-up, or on restarting a post-standby applicator. In accordance with the detected temperature, one of the heating modes is selected to heat the adhesive. The applicator warm-up time is thus set in response to the state of the adhesive: If solidified, the adhesive is heated and melted in a maximum supply-power, supply-duration mode; if low-temperature liquefied at, it is heated and melted in a second-magnitude supply-power, supply-duration mode; and if the adhesive temperature is high, it is heated and melted in a minimal supply-power, supply-duration mode.

9 Claims, 6 Drawing Sheets

Le1
Lb
Le2
Lc
Ld
Le3
La
Temperature [°C]
Heater Output [%]
Time [s]
0
50
100
150
200
0
25
50
75
100
0
60
120
180
240
300
360
420
480
540
600
660
720
780
840
900

Le1
Lb
Ld
Lc
Le2
Le3
La
Temperature [°C]
Heater Output [%]
Time [s]
0
50
100
150
200
0
25
50
75
100
0
60
120
180
240
300
360
420
480
540
600
660
720
780
840
900

Le1
Lb
Ld
Lc
Le2
Le3
La
Temperature [°C]
Heater Output [%]
Time [s]
0
50
100
150
200
0
25
50
75
100
0
60
120
180
240
300
360
420
480
540
600
660
720
780
840
900

HOT-MELT ADHESIVE TEMPERATURE CONTROL METHOD, APPLICATOR THEREFOR, AND BOOKBINDING APPARATUS

BACKGROUND OF THE INVENTION

1. Technical Field

The present invention relates to adhesive applicators and bookbinding apparatuses employing the adhesive applicators, wherein sheets sequentially conveyed out from an image forming device or other printing machine are registered into a set by aligning the sheets and stacking them into a bundle, and glue or other adhesive is applied to an edge of the sheet bundle; more particularly the invention relates to improvements in temperature control when a solid hot-melt adhesive is charged into a tub-shaped container and melted at a predetermined temperature by a heater with which the container is equipped.

2. Description of the Related Art

Generally, this kind of bookbinding apparatus is widely used as a terminal device of an image forming apparatus such as a printer or printing machine, to stack and align printed sheets in page order to form a bundle, to apply adhesive to an edge thereof and then to bind that sheet bundle to a cover sheet. Adhesive application devices built into such bookbinding apparatuses use a container that holds adhesive such as glue and an applicator roller provided inside the container to apply liquefied adhesive to a side edge of the sheet bundle. A heater is built into the container to melt solid adhesive filled into the container and to maintain the liquefied adhesive at a temperature at which the viscosity of the adhesive is appropriate for adhesion.

This method of thus supplying the solid adhesive into the device interior and then heating the adhesive to melt it is characterized by ease of handling the adhesive. However, close attention must be paid to controlling the temperature of the adhesive after it has melted in the container. For example, the melting point of ordinarily employed solid adhesives is on the order of from 60° C. to 80° C., and onto material such as sheets to be glued, the adhesive must be kept at a temperature between 140° C. and 150° C. Should the adhesive temperature happen to be lower than its optimum temperature, clumps in the form of solids that have not melted completely may be included in the container, or strongly viscid (high-viscosity) adhesive may be applied to the sheet bundle. This situation can lead to trouble such as leaves missing from a glued booklet, owing to the adhesive not having permeated the sheet bundle between its pages.

Also, if the temperature of the adhesive is higher than the optimum temperature mentioned above, viscosity will become lower (or weaker) and this will cause a problem of droplets of adhesive being splattered in the process of applying the adhesive to a sheet bundle. This can cause the cover sheet to become soiled or stained. Concurrent with these problems, the melting parameters after a hot-melt adhesive is charged into a container differ depending on whether the fill quantity is a large-volume or small-volume. The melted adhesive in the container re-solidifies when the apparatus is in disuse for an extended period. Moreover, the degree of solidification is also affected by the ambient temperature. Therefore, when starting the bookbinding apparatus, it is necessary to quickly melt new, solid adhesive or adhesive that has re-solidified, and to maintain the adhesive at a predetermined temperature.

In conventional solid adhesive temperature control, a warming mode, such as that disclosed in Japanese Unexamined Pat. App. Pub. No. 2005-238526, is provided so that the liquefied adhesive in the container does not re-solidify when the apparatus is in disuse for an extended period and adhesive is not being applied to sheets. This document discloses warming modes that when adhesive is not being applied to sheet bundles in the bookbinding apparatus, or when the apparatus is idle, maintain the adhesive container at a temperature lower than the application temperature.

Pub. No. 2005-238526 also discloses providing a glue-storing container with an induction heating coil, and melting the adhesive in the container with the Joule heat from eddy currents due to the high-frequency magnetic flux generated in the coil. Also disclosed is adjusting the current supplied to the coil according to the adhesive temperature detected by a sensor (thermistor) equipped in the container. The same publication discloses providing mixing means to keep adhesive melted in the container at a uniform temperature.

As described above, when applying an adhesive inside a container to a sheet bundle in a bookbinding apparatus or similar device, employing a hot-melt adhesive that becomes solid at ordinary temperatures facilitates handling. Drawbacks with such adhesives are that when the apparatus is in non-operational or on standby, the liquefied adhesive solidifies, and that when the apparatus is started up, solidified adhesive, or freshly replenished adhesive, must in a short period of time be dissolved and brought to a temperature appropriate for its application. Liquefying (bringing to the appropriate temperature) solid adhesive is time-consuming. This causes the problem of having to wait to operate the machine until the adhesive has sufficiently melted.

To address such problems, to date it has been proposed, as disclosed in Japanese Unexamined Pat. App. Pub. No. 2005-238526 to maintain a heating means for the container in an operational state when the apparatus is idle. Specifically, current continues to energize the heating elements of a heater while the apparatus is idle, but this results in wasted energy consumption. There is also the danger of causing a fire if current is continually supplied to the heating elements while the machine is not in use. An additional drawback is that preparation time for the adhesive to melt is required when starting up the apparatus.

Furthermore, as disclosed in Japanese Unexamined Pat. App. Pub. No. 2003-010748, attempts have been made to dissolve the container contents in a short time with a high-frequency heating device. This approach, however, leads to high-cost and safety issues, because ordinary high-frequency heating devices operate at frequencies appreciably higher than the frequency at which commercial power is supplied.

Thus, within bookbinding apparatuses or like machines hot-melt adhesives—solidified adhesive when starting up a machine or when restarting an idle machine—must be dissolved in a short time, but with employing a large-capacity heating device such as a high-frequency heating apparatus having been the common practice to date, the problems for bookbinding apparatuses made compact and all purpose in office equipment have been increased size, higher cost, and higher power consumption. A concurrent problem has been that because liquefied adhesive in the container cannot be expected to circulate by convection the adhesive must be stirred; and as disclosed in Pat. App. Pub. No. 2003-010748, the adhesive must be mixed at the same time it is being melted.

A problem in this regard has been that if the viscosity of the liquefied adhesive is high, the adhesive exerts excessive load on the mixing means and its drive mechanism, which proves to be a cause of mechanical failure. In other words, if a solid adhesive is stirred too early after the adhesive has been dissolved, the viscosity load produces an overload on the drive motor. This can cause faulty operation.

BRIEF SUMMARY OF THE INVENTION

Therefore, the present invention provides an adhesive applicator equipped with a plurality of heating modes for melting adhesive in solid or semisolid (gel) form. By heating in a mode selected according to the state of the adhesive temperature, it is possible to warm-up for machine operation in a comparatively short amount of time, without having to increase the size of the heating apparatus.

The present invention also provides an adhesive applicator that can reliably stir liquefied adhesive without the stirring means or its drive source experiencing a mechanical failure when stirring liquefied adhesive while it is melting in the container to a uniform state for application. Still further, the present invention provides a bookbinding apparatus that efficiently warms up when started, to align and bind sheets discharged from an image forming apparatus.

The present invention employs the following configuration to solve the problems described above. A temperature control means that controls the heating temperature of the heating means disposed on a container storing adhesive has the following configuration. A plurality of heating modes having different power supplies and supply times to the heating means is provided in the temperature control means. For example these modes are composed of a plurality of modes that have different power supplies and supply times to the heating means. A sensor means detects the temperature of the adhesive in the container when starting up the apparatus, or when restarting the apparatus (hereinafter this is referred to as starting the apparatus) after the apparatus has been idle. One heating mode is selected according to the detected temperature to heat the adhesive.

The warm-up time of the apparatus is configured to correspond to the state of the adhesive. For example, when the adhesive is in solid form, the adhesive is heated and melted in a mode having maximum power and time to be supplied. When the adhesive is liquefied at a low temperature, it is heated and melted in a mode having a second, lower supply power and supply time. When the adhesive temperature is high, it is heated and melted in a mode that has a minimum supply power and supply time.

Therefore, when adhesive is completely solidified, the warming up time is longer, and when the adhesive temperature is high, the warming up time is shortened. In other words, when starting up the apparatus if it is in a low temperature state, initialization of the device takes time, but when starting up the apparatus when it is at a high temperature, such as when restarting the apparatus, less time is required for initialization, so power consumption can be reduced. Also, with these heating modes, the power and time supplied are varied gradually until the adhesive in the container reaches a predetermined temperature. For example, a first step supplies a first power at a first supply time and a second step supplies a second power at a second supply time to control using the functions of power and time. Because the temperature of the adhesive in the container has the property of being notably delayed behind the temperature of the heating means, by experimentation a control table is prepared for the power (supplied current) and time supplied to avoid overheating (excessive heating) and under heating (insufficient heating).

In other words, in an instance in which the temperature of an adhesive at 70° C. is to be adjusted to 150° C., if the heating means is set to 170° C., the adhesive temperature, lagging timewise, will gradually approach 150° C., wherein even if the heating means is halted, due to the high temperature of the container, the adhesive temperature will surpass 150° C. and overheat to 160° C., for example. Conversely, if the heating means is set to 150° C., and is to be halted when the adhesive temperature is 150° C. or less, it will take a longer amount of time to reach 150° C. In order to shorten the warming-up time, controlling the heating means according to a preestablished heating pattern is advantageous.

A sensor means such as a thermistor detects the adhesive temperature, but the heating processes of the adhesive and the container are different. A liquid temperature sensor that directly detects the adhesive temperature and a heating unit temperature sensor that detects the temperature of the container heating unit are provided. One of the heating modes described above is selected according to the temperature detected by either sensor. Also, the power supply is controlled to change gradually when the heating unit sensor detects a predetermined temperature in the process to execute the heating mode. This makes it possible to control the adhesive temperature to an appropriate temperature.

Next, because the viscosity of the adhesive is high and its fluidity is low when it is near its melting temperature in the container, the adhesive must be stirred in the container. Carrying out the stirring by rotating an applicator roller provided inside the container makes for a simple configuration. Also, after the sensor means detects the predetermined temperature, the applicator roller is controlled to start rotating. For example, when the heating unit temperature sensor that detects the temperature of the container heating unit has reached a predetermined temperature, this is configured to start rotating after an estimated amount of time for the adhesive in the container to become liquefied and to take on the predetermined fluidity. Also, the applicator roller does not rotate in a single direction, but reverse-rotates in the direction opposite to the application direction, and then forward-rotates in the application direction. Note that the estimated time mentioned above is set to different times for the plurality of heating modes.

The bookbinding apparatus of the present invention is provided with stacking means that aligns sheets sequentially discharged from an image forming apparatus or the like, into a sheet bundle, and sheet bundle conveyance means that conveys a sheet bundle from the stacking means to a predetermined binding position. Also, an adhesive applicator is provided that applies adhesive to an edge of the sheet bundle in the binding position and this adhesive applicator employs the configuration described above. The container storing adhesive is supported on an apparatus frame to move along an edge of the sheet bundle, and is reciprocatingly moved by a drive motor, which makes the container comparatively more compact.

The present invention provides a plurality of heating modes that have different supplied power and supply times for heating means arranged at the container that stores adhesive. By selecting and executing one of the heating modes according to the temperature of the adhesive detected by sensor means when starting up the apparatus, it is possible to warm up the apparatus and enable operation in a comparatively short amount of time using a heating mode that is preset according to a status of the temperature of the adhesive when starting up the apparatus. At the same time as this, a stirring rotor such as an applicator roller is disposed on the container to rotate when the adhesive in the container has reached a predetermined viscosity to attain a uniform temperature status of the adhesive, without inviting the problems of operational problems or breakdowns of the drive system, such as the applicator roller.

Particularly, the heating modes can accurately control the temperature of adhesive that is delayed after the charging of power, in a short amount of time by varying the power, for example the current, applied to the heating means and the charging time, according to estimates obtained by experiment and other means. By setting these heating modes to a plurality of patterns that differ according to the initial temperature status of the adhesive (such as the temperature of the apparatus at startup), it is possible to warm up the apparatus at startup even more efficiently.

From the following detailed description in conjunction with the accompanying drawings, the foregoing and other objects, features, aspects and advantages of the present invention will become readily apparent to those skilled in the art.

BRIEF DESCRIPTION OF THE SEVERAL VIEWS OF THE DRAWINGS

FIG. 1 is explanatory drawings showing a configuration of an adhesive container that holds solid adhesive, wherein

FIG. 4 is charts diagramming temperature fluctuations when in a heating mode in a temperature control of heating means, wherein

FIG. 5 is a view of an image forming system with the adhesive applicator of FIG. 1 built in.

DETAILED DESCRIPTION OF THE INVENTION

Figure 1A:
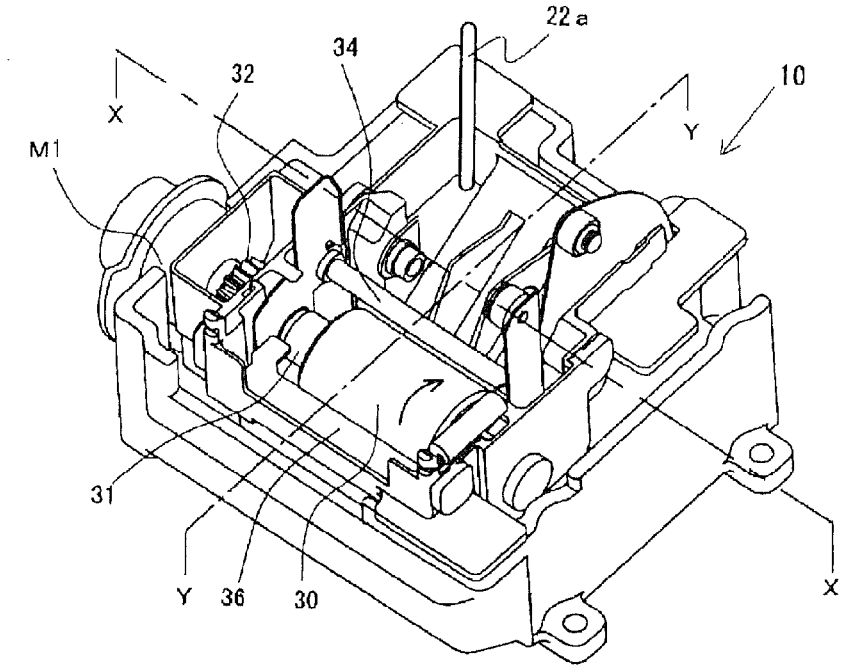
FIG. 1A is a perspective view of an external shape.
Figure 1B:
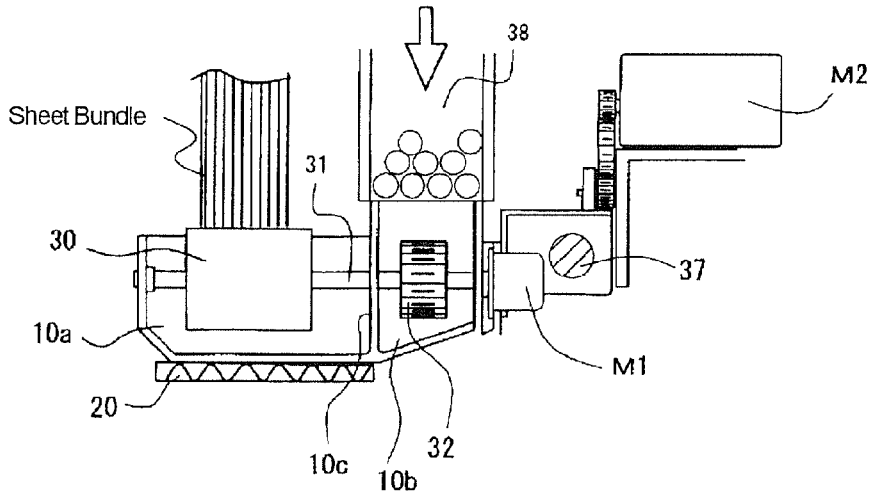
FIG. 1B is a sectional view in the X-X direction.
Figure 1C:
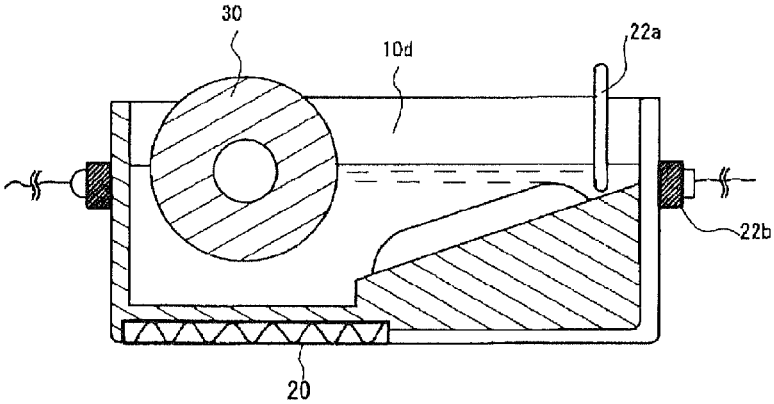
FIG. 1C is a sectional view in the Y-Y direction.
Figure 2:
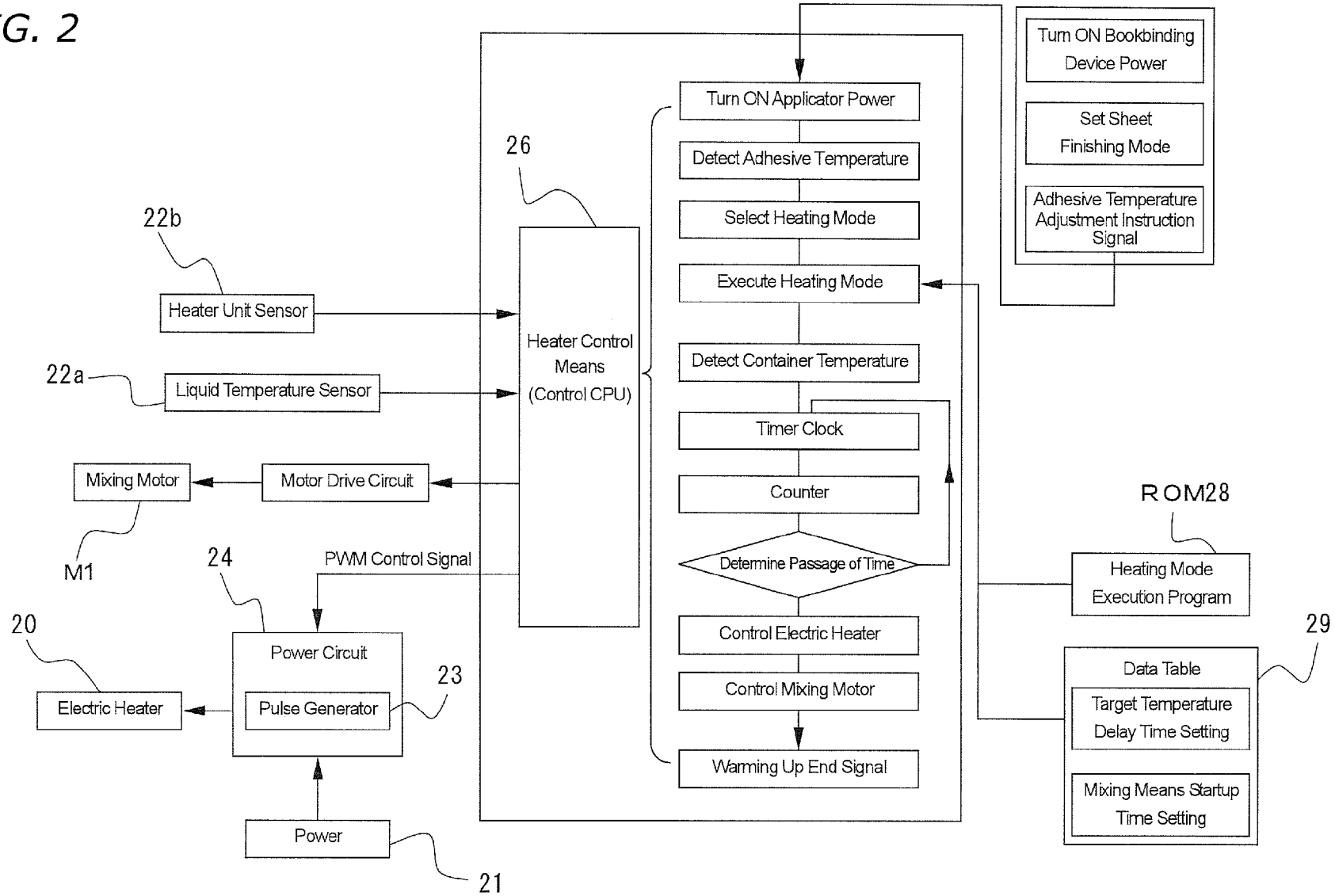
FIG. 2 is a block diagram of a configuration of a temperature control means that heats and melts solid adhesive.
Figure 3:
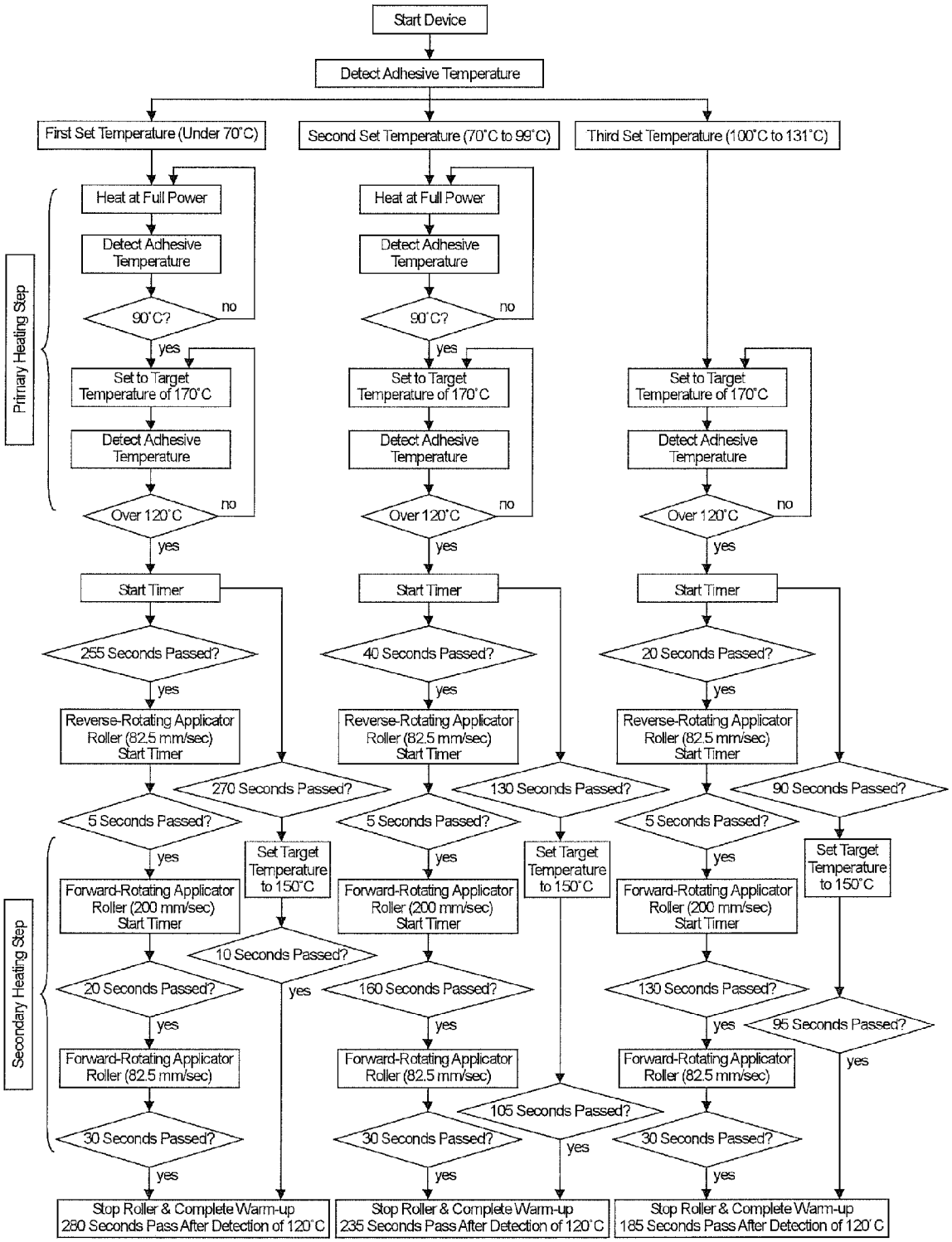
FIG. 3 is a flowchart of actions of the temperature control means.

A preferred embodiment of the present invention will be explained based on the drawings provided. The adhesive applicator B of the present invention will be explained first with reference to FIGS. 1 to 4. FIGS. 1A to C are explanatory views of a configuration of the adhesive container that stores solid adhesive; FIGS. 1B and 1C are sectional views thereof. FIG. 2 is a block diagram of a configuration of a temperature control means that heats and melts adhesive. FIG. 3 is a flowchart showing the actions of the temperature control means. FIG. 4 is a chart showing fluctuations in adhesive temperature.

In FIG. 1B, a solid adhesive filling chamber (hereinafter referred to as a filler chamber) 10*b* and an application adhesive tank (hereinafter referred to as a liquid tank) 10*a* are separated by a wall 10*c* in a container 10 that holds adhesive. Communicating holes are provided in the wall 10*c* to allow adhesive that has become liquefied in the filler chamber 10*b* to flow into the liquid tank 10*a*. The container 10 is composed of a tub-shaped tray having this filler chamber 10*b* and liquid tank 10*a*, and is either formed with a metal having high thermal conductivity properties or it has a thermally conductive plate laid at the bottom of the container after forming it of a plastic material that has superior forming characteristics.

An applicator roller 30 is rotatably supported on a bearing inside the liquid tank 10*a*. This applicator roller 30 is formed by a heat-resistant rubber material that has superior impregnating ability, and is arranged so that an upper half thereof projects upward of the liquid tank 10*a*, and a bottom half dips inside of the liquid tank 10*a*. The rotation of the applicator roller 30 dips the bottom half of the roller into liquefied adhesive, and the upper half that projects upward applies the adhesive to the sheet bundle. A rotating shaft 31 of the applicator roller 30 is longitudinally arranged at the filler chamber 10*b* via communication holes, and a stirring gear 32 that stirs the adhesive in the filler chamber 10*b* is mounted to this rotating shaft 31.

A stirring motor M1 that is capable of both forward and reverse rotation is connected to this rotating shaft 31. Therefore, the rotational drive of the stirring motor M1 rotates the applicator roller 30 and the stirring gear 32 so the applicator roller 30 stirs the adhesive inside the liquid tank 10*a* and the stirring gear 32 stirs the adhesive in the filler chamber 10*b*. Therefore, the stirring gear 32 and applicator roller 30 compose a stirring rotor, and the stirring motor M1 composes their drive means. 10*d* in the drawings is an adhesive liquid storage unit. This forms a basin for supplying adhesive to the applicator roller 30 at a stable temperature without the adhesive becoming insufficient.

A liquid temperature sensor 22*a* is provided to detect a temperature of liquefied adhesive in the adhesive liquid storage unit 10*d*. This liquid temperature sensor 22*a* is composed of a bar-shaped thermistor and is arranged at the adhesive liquid storage unit 10*d* separated from the applicator roller 30. This thermistor is composed of a sintered fine-ceramic semiconductor heat-sensitive element made of several types of transition metal oxides such as Mn, Co, Ni, Fe and Cu.

The liquid temperature sensor 22*a* shown in the drawing detects the liquid surface (the remaining amount of adhesive) of the adhesive at the same time as detecting the temperature. Specifically, this determines the liquid amount from the temperature changes using the liquid surface of the adhesive heated to a temperature higher than room temperature, and detects the residual amount of the adhesive. In that case, the liquid temperature sensor 22*a* is arranged at the adhesive liquid storage unit 10*d* separated from the applicator roller 30 so that the detection of the liquid surface is unaffected by the rotation of the applicator roller 30.

Also, the symbol 34 in the drawings is the control bar. This is arranged along a circumference of the applicator roller 30 in a machine direction of the container, and at a predetermined distance along the circumference of the applicator roller 30 to apply adhesive uniformly to the circumference of the roller. This control bar 34 adjusts the gap with the roller according to the position of the sheet bundle. In the drawings the symbol 36 is a plate-shaped blade arranged to form a predetermined distance (doctor gap) to the circumference of the applicator roller 30 to sweep away excess adhesive adhering to the roller circumference.

Heating means consisting of an electric heater 20 is equipped on such a container 10. This electric heater 20 is built into the bottom side of the liquid tank 10*a* of the container 10. It is acceptable to arrange the electric heater 20 on either the liquid tank 10*a* or the filler chamber 10*b*, or on both. In the drawings the filler chamber 10*b* and liquid tank 10*a* are separated by a wall to prevent the temperature of the adhesive saturated on the applicator roller 30 from dropping when solid adhesive is filled. It is acceptable to preheat the solid adhesive by arrange an electric heater inside the filler chamber 10*b*.

The following will explain the control of the heating means (electric heater 20) arranged inside the liquid tank 10*a*.

The liquid temperature sensor 22*a*, and a heater unit temperature sensor 22*b* that detects the temperature of the container heater unit are arranged in the container explained above. Also, an error temperature detection sensor, not shown, is provided in the container 10. The liquid temperature sensor 22*a* directly detects the adhesive temperature inside the container 10 as described above, and the heater unit temperature sensor 22*b* is arranged to detect the temperature of the container heater unit when the container 10 temperature is raised by the electric heater (embedded in the liquid tank 10*a*) embedded in the container 10. The error temperature detection sensor is arranged, for example, in the container 10 and executes safety measures such as turning off the heater electricity when it detects that the adhesive and container are overheated. These sensors are each connected to a control CPU 26 (see FIG. 2).

This control CPU 26 is prepared as a controller of the bookbinding apparatus A, described below, or the adhesive applicator B. It is recorded with a heating control execution program (for example ROM 28) as shown in FIG. 2. Also, data (for example, a target temperature that sets the charging current value, charging times, and a timing setting time) for executing the heating mode, described below, are prepared in a data table 29. Electric power (direct current electric power) 21 and a pulse generator 23 are connected to the electric heater 20 arranged at the container 10, and this pulse generator is controlled by the temperature control means composed of the control CPU 26. Therefore, a pulse current that corresponds to a command signal from the temperature control means (control CPU) 26 is supplied to the electric heater 20. An electric circuit 24 equipped with the pulse generator 23 is composed of a PWM (pulse width modulation) control circuit and is configured to change the voltage by varying the pulse width of the power by a command signal from the control CPU 26.

With this configuration, the heating means (electric heater 20) is controlled to generate heat in the following three heating modes. Power to the bookbinding apparatus A is turned on, and when a temperature control starting command is issued, the adhesive applicator B receives this command. Then, the adhesive applicator B first detects the adhesive temperature in the container 10. This adhesive temperature is detected by using either the liquid temperature sensor 22*a* or the heating unit temperature sensor 22*b*. (When the apparatus is started up normally, they are both the same temperature.)

As shown in FIG. 3, the heating means 20 is controlled in the following way by the temperature control means (control CPU) 26 when the adhesive temperature is at a first setting temperature range (less than 70° C. in the drawings) for the first mode; when the adhesive temperature is at a second setting temperature range (between 70° C. and 99° C. in the drawings) for the second mode; and when the adhesive temperature is at a third setting temperature range (between 100° C. and 131° C. in the drawings) for the third mode.

The following will explain temperature control for the apparatus shown in the drawings, presuming the adhesive temperature is not above 130° C. when the temperature control command is issued, and that the melting point of the adhesive is 70° C. and the adhesive temperature at the optimum condition to apply to sheets is 150° C.

First Heating Mode

The first heating mode is composed of the following primary heating step and secondary heating step.

Primary Heating Step

Electric power is supplied to the heating means 20 at full power until the heating unit temperature sensor 22*b* reaches 90° C. Full power means to supply electric power at maximum output (251 watts) of the tolerance of the electric circuit mentioned above. The pulse current supplied from the pulse generator 23, explained above, to the electric heater 20 is adjusted by command from the temperature control means (control CPU) 26 when heating at full power. When the heating unit temperature sensor 22*b* equipped at the container 10, detects the container temperature to be 90° C., the target temperature is set to 170° C., and electric power that corresponds to that target temperature is applied to the electric heater 20.

Secondary Heating Step

When the heating unit temperature sensor 22*b* detects the container temperature to be 120° C., the target temperature is set to 150° C. after a delay time Ta1 (270 seconds) after this detection signal, and electric power that corresponds to this target temperature is applied to the electric heater 20. Note that the temperature of 150° C. is the final temperature setting to adjust the final temperature of the adhesive. At the same time as that temperature adjustment, the applicator roller 30 is rotated by the stirring motor M1. The rotation of the applicator roller 30 stirs the adhesive whose temperature has risen to the melting point in the liquid tank 10*a* of the container 10.

When the heating unit temperature sensor 22*b* detects the temperature of 120° C., the applicator roller 30 is rotated in the opposite direction (reverse rotation to the application direction) for five seconds after a delay time Tb1 (255 seconds) after this detection signal. The circumference speed at this time is set to 82.5 mm/sec (low speed). The reason for causing the applicator roller 30 to rotate in reverse is to sweep away solidified adhesive on the circumference of the roller using the control bar 34. The reason for limiting the reverse rotation to five seconds is because adhesive will overflow if rotated in that way, and the fluidity of the adhesive is better in the forward rotation than the opposite rotation.

The applicator roller 30 is rotated at the low speed. When five seconds have passed, the applicator roller 30 is rotated in the forward direction at 200 mm/sec (high speed). After this high speed rotation is continued for 20 seconds, the applicator roller 30 is rotated in the forward direction for 30 seconds at 82.5 mm/sec (low speed). 280 seconds are required after the container temperature reaches 120° C. for the adhesive in the container to reach its final temperature setting of 150° C., then the warming up time is ended. After this waiting time, a warming up end signal is issued.

Second Heating Mode

The second heating mode is composed of the following primary heating step and secondary heating step.

Primary Heating Step

In the same way as the first heating mode, electric power is supplied to the heating means 20 at full power until the heating unit temperature sensor 22*b* reaches 90° C. Next, when the heating unit temperature sensor 22*b* equipped at the container 10 detects the container heater temperature to be 90° C., the target temperature is set to 170° C., and electric power that corresponds to this target temperature is applied to the electric heater 20.

Secondary Heating Step

When the heating unit temperature sensor 22*b* detects the container heater temperature to be 120° C., the target temperature is set to 150° C. after a delay time Ta2 (130 seconds) after a detection signal, and electric power that corresponds to this target temperature is applied to the electric heater 20. At the same time as that temperature adjustment, the applicator roller 30 is rotated by the stirring motor M1. The rotation of the applicator roller 30 stirs the adhesive whose temperature has risen to the melting point in the liquid tank 10*a* of the container 10. When the heating unit temperature sensor 22*b* detects the temperature of 120° C., the applicator roller 30 is rotated in the opposite direction (reverse rotation to the application direction) for five seconds after a delay time Tb2 (40 seconds) after this detection signal. The circumference speed at this time is set to 82.5 mm/sec (low speed).

The applicator roller 30 is rotated at the low speed. When five seconds have passed, the applicator roller 30 is rotated in the forward direction at 200 mm/sec (high speed). After this high speed rotation is continued for 160 seconds, the applicator roller 30 is rotated in the forward direction for 30 seconds at 82.5 mm/sec (low speed). 235 seconds are needed after the container heater unit temperature reaches 120° C. for the adhesive in the container 10 to reach its final temperature setting of 150° C., then the warming up time is ended. After this waiting time, a warming up end signal is issued.

Third Heating Mode

The third heating mode is composed of the following primary heating step and secondary heating step.

Primary Heating Step

Electric power is supplied to the heating means 20. The power supply is set to the target temperature of 170° C., and electric power that corresponds to that target temperature is applied to the electric heater 20.

Secondary Heating Step

When the heating unit temperature sensor 22*b* detects the container heater temperature to be 120° C., the target temperature is set to 150° C. after a delay time Ta3 (90 seconds) after a detection signal, and electric power that corresponds to this target temperature is applied to the electric heater 20. At the same time as that temperature adjustment, the applicator roller 30 is rotated by the stirring motor M1. The rotation of the applicator roller 30 stirs the adhesive whose temperature has risen to the melting point in the liquid tank 10*a* of the container 10. When the heating unit temperature sensor 22*b* detects the temperature of 120° C., the applicator roller 30 is rotated in the opposite direction (reverse rotation to the application direction) for five seconds after a delay time Tb3 (20 seconds) after this detection signal. The circumference speed at this time is set to 82.5 mm/sec (low speed).

The applicator roller 30 is rotated at the low speed. When five seconds have passed, the applicator roller 30 is rotated in the forward direction at 200 mm/sec (high speed). After this high speed rotation is continued for 130 seconds, the applicator roller 30 is rotated in the forward direction for 30 seconds at 82.5 mm/sec (low speed). 185 seconds are needed after the container heater unit temperature reaches 120° C. for the adhesive in the container 10 to reach its final temperature setting of 150° C., then the warming up time is ended. After this waiting time, a warming up end signal is issued.

The temperature settings of 90° C. and 120° C. in each of the first to the third heating modes are set with consideration to the following. First, the temperatures settings near the electric heater, and adhesive near to and far from this heater are different. Particularly, the temperature distribution in solid or gelatinous adhesives varies greatly because the adhesives are not convective. Therefore, the differences are big because if the temperature of the heater itself is detected, the set temperature is quickly reached, and if the temperature of the adhesive itself is detected, the temperature rises slowly, and because of the amount of adhesive amount. Because there are many unstable elements in detecting the temperatures of the heater and the adhesive, the temperature of the container heater arranged with a heater is detected.

The temperature setting of 90° C. is suitable so that the adhesive temperature from the melting point (70° C. in the drawings) does not overheat the target of 150° C. If this is set low, it takes time to reach the target temperature, and if it is set high, there is the possibility of exceeding the target temperature. In the same way, the temperature setting of 120° C. is a standard temperature for controlling at the delay time Ta (Ta1=270 seconds in the first heating mode; Ta2=103 seconds in the second heating mode; Ta3=90 seconds in the third heating mode) found through experimentation of the heater.

This temperature is not limited to 120° C. and can be set to any degree. These three heating modes charge electric power to the heating means as a primary heating step that corresponds to the initial temperature of the adhesive until the temperature of the container heating unit equipped with heating means 20 reaches the predetermined temperature (set to 120° C. in the drawing). After the container heating unit reaches a predetermined temperature, the second stop supplies electric power to the heating means varying the target temperature gradually after the delay time Ta set by experimentation, such as by using a timer, has passed. Because the adhesive temperature, container temperature (container heating unit temperature), and heater temperature differences and fluctuations are great due to the conditions (desired temperature, container volume) of the adhesive for the reasons described above, the heater is controlled according to a time set (the Ta time described above) by experimentation after the temperature of the container heater reaches a predetermined temperature.

Therefore, the temperature settings of 90° C. and 120° C. must be set according to the configuration of the heating device. For example, these settings must be set according to the heater capacity. Depending on the configuration, there is room for more than three settings, or to raise the set temperature. The power supply for each mode and the supply times are each set to values gained from experience and through testing. Also, the primary heating step supplies electric power until the temperature of the container heater unit reaches the predetermined temperature, and the secondary step supplies predetermined amount of electric power for a preset amount of time.

Figure 4A:
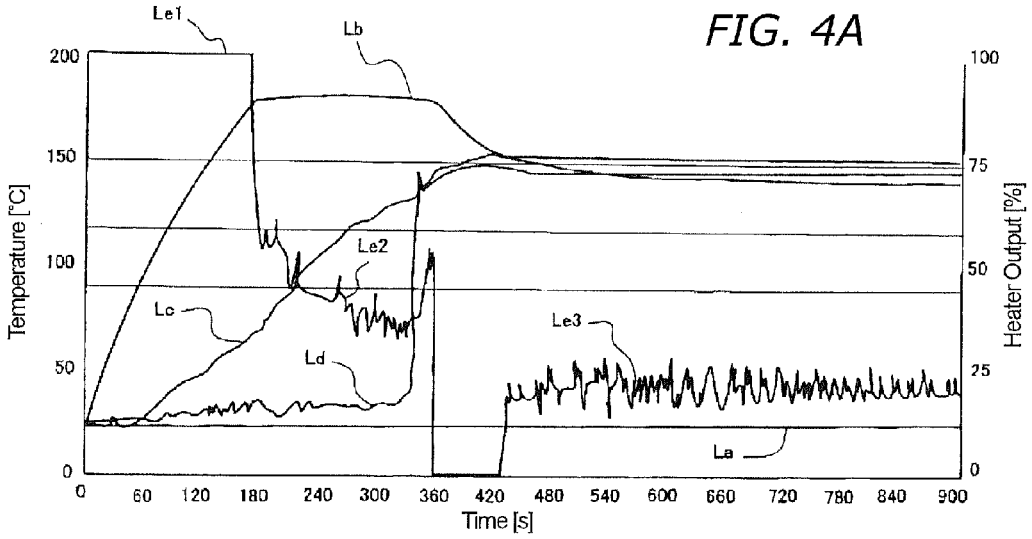
FIG. 4A shows temperature fluctuations in a first heating mode.
Figure 4B:
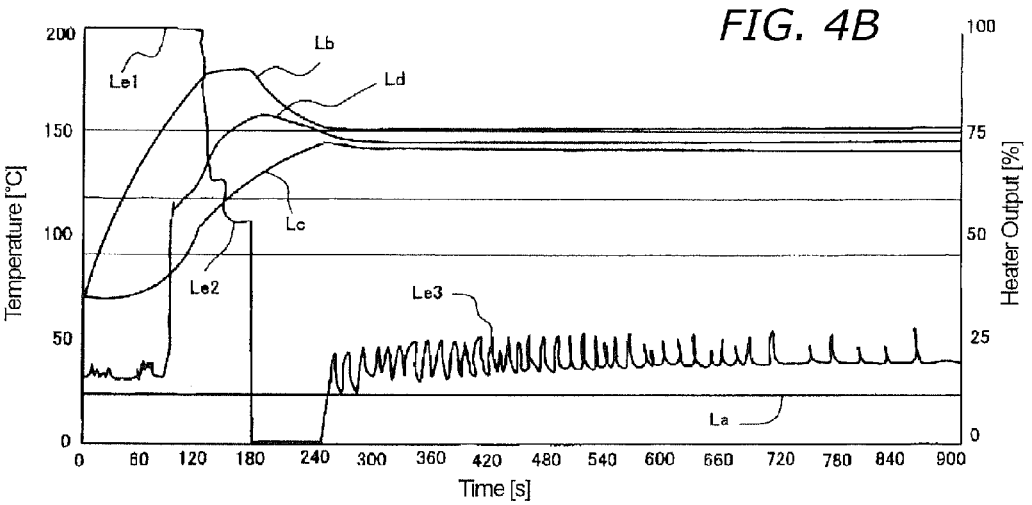
FIG. 4B shows temperature fluctuations in a second heating mode.
Figure 4C:
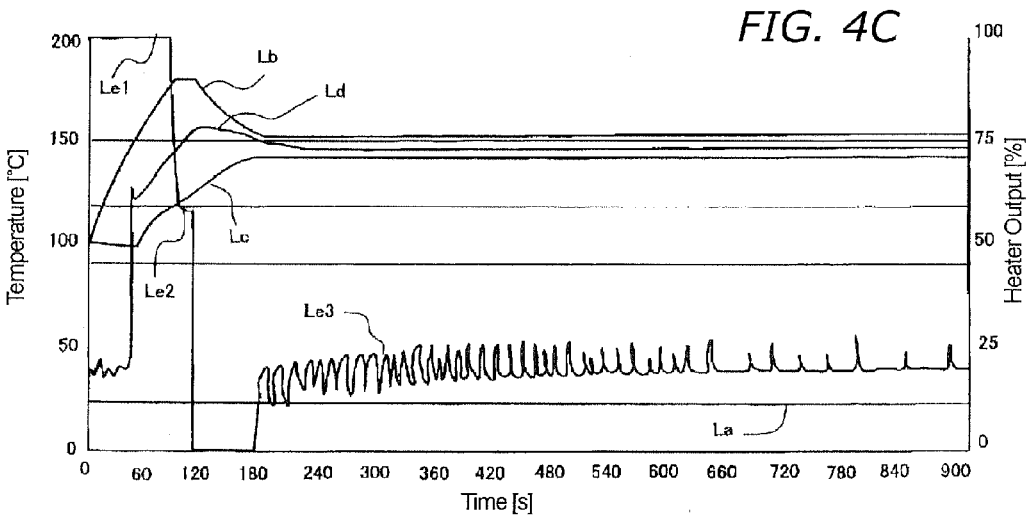
FIG. 4C shows temperature fluctuations in a third heating mode.

FIGS. 4A, 4B, and 4C show fluctuations in adhesive temperature over time in the heating modes described above. In FIG. 4A, the initial temperature of the adhesive is 23° C. This shows the temperature fluctuation when controlling heat with the first heating mode. La in the drawing is the temperature of the ambient air; Lc is the adhesive temperature of the liquid detection sensor; Ld is the adhesive temperature at the applicator roller position; Le is the applied electric power of the electric heater. In these charts, Ld represents values of adhesive temperature on the applicator roller 30 measured by a special temperature sensor equipped on an experimental device. The charged electric power is shown with the duty value of the pulse power. Note that these conditions are the same in the charts.

As is clear from the chart of FIG. 4A, the charged electric power Le is supplied at a time axis (X axis) shown in the drawings with full power Le1; electric power Le2 is applied that is equivalent to the target temperature of 170° C.; and electric power Le3 is applied that is equivalent to the target temperature of 150° C. The temperatures of the container heating units at this time are controlled to 170° C. and 150° C. while maintaining a timed delay. The adhesive temperature Lc of the liquid temperature sensor 22*a* reaches the target temperature of 150° C. parabolically, and the adhesive temperature Ld of the applicator roller quickly reaches the target temperature from an intended temperature.

Next, FIG. 4B shows the temperature fluctuations when temperature is controlled by the second heating mode, described above, if the initial adhesive temperature is 70° C. The symbols La, Lb, Lc and Ld are the same as described above, but different from FIG. 4A, the adhesive temperature of the applicator roller 30 quickly rises from the initial temperature and stabilizes at 150° C. after slightly exceeding the target temperature of 150° C. In the same way, in FIG. 4C, the initial temperature of the adhesive is 101° C., and this drawing shows the temperature fluctuations when controlling heat with the third heating mode.

The following will explain the bookbinding apparatus with the adhesive applicator described above is incorporated.

Figure 5:
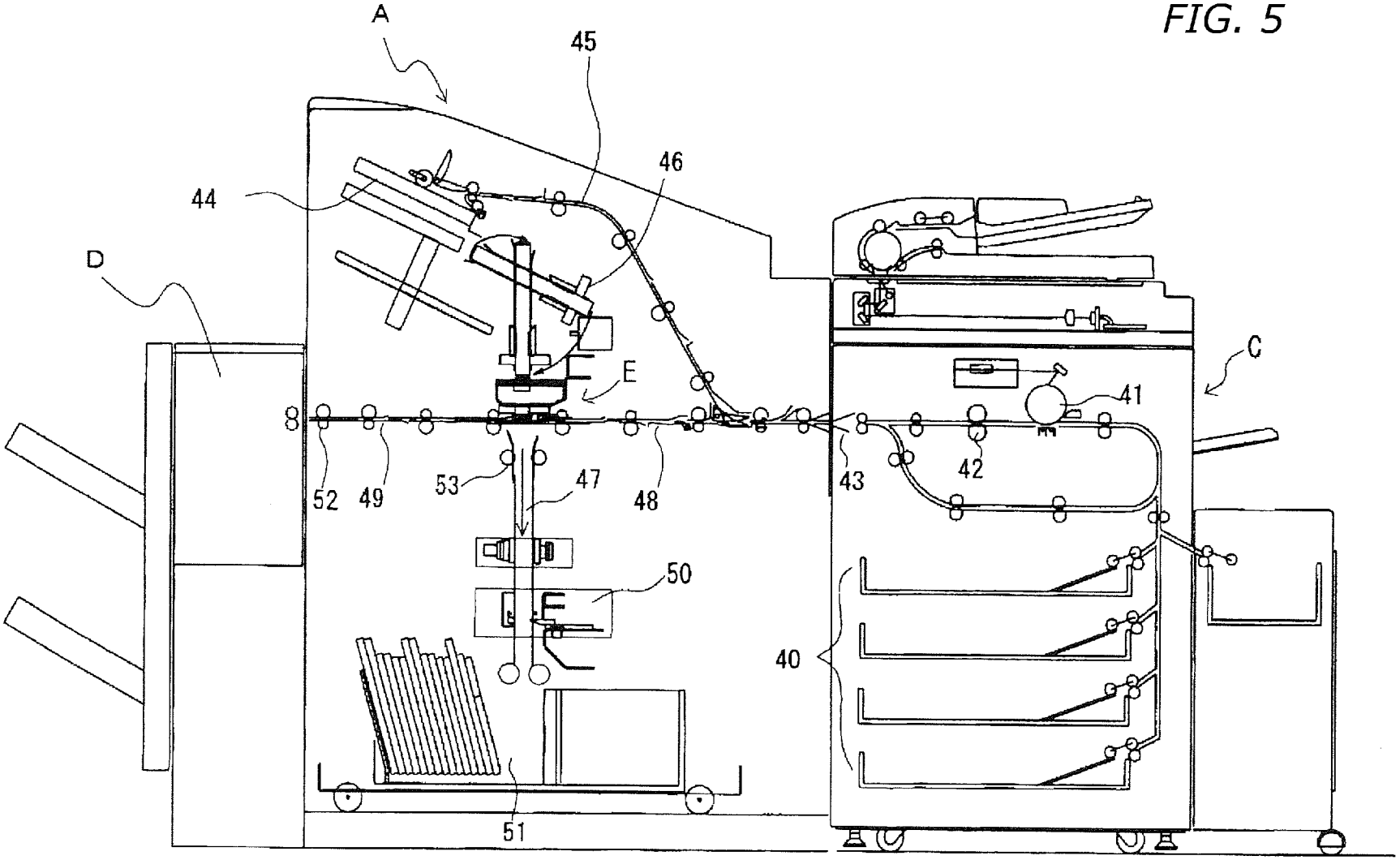
Figure 6:
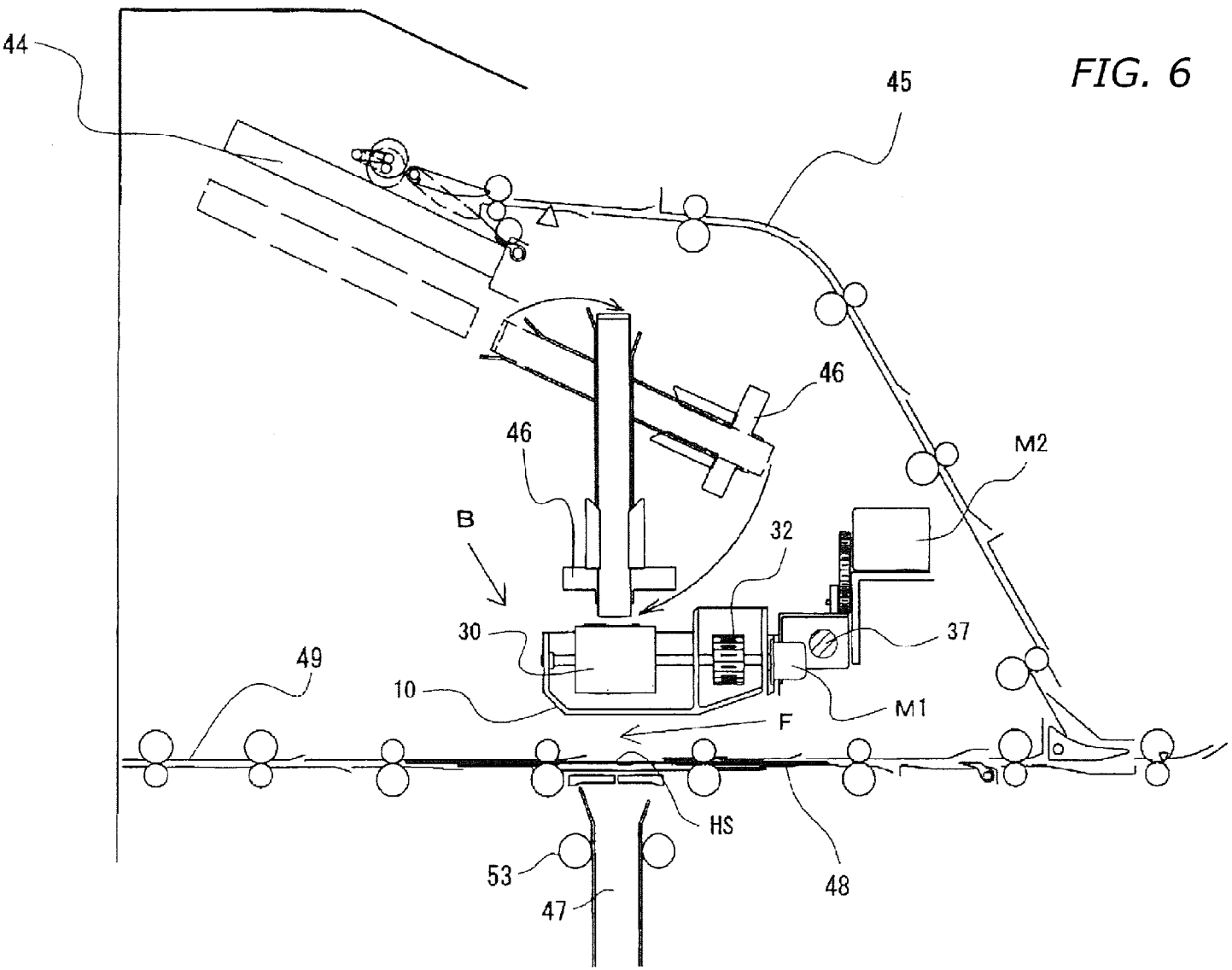
FIG. 6 is a view of the essential portion of the bookbinding apparatus of FIG. 5.

FIG. 5 is an explanatory drawing of the bookbinding apparatus A and an overall configuration of an image forming system equipped with the same. The adhesive applicator B is incorporated into this bookbinding apparatus A. FIG. 6 is an explanatory drawing of the essential portions of the bookbinding apparatus A.

As shown in FIG. 5, the image forming system is composed of a printing apparatus C, and the bookbinding apparatus A that binds printed sheets from the printing apparatus C into booklets, and a stacking apparatus D that conveys and stores printed sheets that will not be formed into a book, is equipped on the bookbinding apparatus A. This printing apparatus C is composed of a known structure of a printer or copier. Shown in the drawings, a predetermined sheet is fed from a cassette provided at a paper feeding unit 40, and a printing drum 41 for example prints to the sheet. A fixer 42 fixes the image by applying heat, and the sheet is sequentially conveyed out of the apparatus from a discharge outlet 43. The printing drum 41 in the drawing is a photoreceptor drum. The drawing shows an electrostatic printing method that forms an electrostatic latent image on the drum surface by a laser transmitter, then transfers that to the sheet. A variety of printing methods such as silk screen printing or ink jet printing can also be employed.

Next, the bookbinding apparatus A aligns printed sheets sequentially discharged from the discharge outlet 43 at a stacking tray 44 for a predetermined number of sheets. The symbol 45 in the drawing is a sheet conveyance-in path that guides printed sheets from the discharge outlet 43 to the stacking tray 44. A sheet bundle aligned and organized on the stacking tray 44 is conveyed to an adhesive application position E (see the arrow in FIG. 6) by gripping conveyance means 46. Particularly, shown in the drawing, the stacking tray 44 is arranged in a substantially horizontal posture, and a bookbinding path 47 where the gripping conveyance means 46 moves the sheet bundle is arranged in a substantially vertical direction. The gripping conveyance means 46 grip a sheet bundle with gripping means on the front and backsides, and turn the sheet bundle first from a horizontal posture to a vertical posture, then conveys the sheet bundle in the bookbinding path 47 in a vertical direction.

Also, a cover sheet conveyance path 48 that feeds a cover sheet is branchingly connected at this sheet conveyance path 45. A sheet conveyance out path 49 is connected to this cover sheet conveyance path 48. Specifically, printed sheets from the discharge outlet 43 of the printing apparatus C are fed from the sheet conveyance in path 45 to the stacking tray 44, and a cover sheet conveyed out from the discharge outlet 43 is supplied to the cover sheet conveyance path 48 that branches from there. At the same time, printed sheets that will not undergo the bookbinding process are conveyed through the bookbinding apparatus A to the stacker apparatus D from the sheet conveyance out path 49 from the discharge outlet 43 via the sheet conveyance in path 45 and the cover sheet conveyance path 48.

The bookbinding path 47 and the cover sheet conveyance path 48 are arranged to mutually intersect. The sheet bundle conveyed from the bookbinding path 47, and the cover sheet conveyed from the cover sheet conveyance path 48 are joined at the intersection F (see the arrow in FIG. 6). In other words, the cover sheet HS is conveyingly supplied so that a center line matches an intersecting point at the intersection F, and the sheet bundle is aligned at an upside-down-T shape looking from the bookbinding path 47 intersecting thereto. The sheet bundle is then bound with the cover sheet by folding rollers arranged at a downstream side of the intersection F in the bookbinding path 47. The adhesive applicator B is incorporated as a unit upstream of the intersection F of the bookbinding path 47.

The sheet bundle gripped by the gripping conveyance means 46 and held at an upright posture at the adhesive application position E is applied with a predetermined amount of adhesive (glue) at a bottom edge. The container 10 explained in relation to FIGS. 1 to 4 is arranged to move along the bottom edge of the sheet in the adhesive applicator B. The container 10 equipped with the adhesive heating means has the aforementioned configuration. Therefore an explanation thereof will be omitted.

The container 10 is supported to move on a guide rail along a length direction of the sheet bundle held by the gripping conveyance means 46, and is reciprocatingly moved by a reciprocating motor M2. In this way, the container 10 is supported to move in a length direction (a direction perpendicular to the bundle thickness) along the backside of the sheet bundle, and is reciprocatingly moved by a reciprocating motor M2. At that time, the applicator roller 30 of the container 10 is rotated by the stirring motor M1 in a predetermined direction, for example a moving direction of the container and an opposite direction. When it is rotated, the adhesive impregnated on the applicator roller 30 is applied to the back of the sheet bundle. After the application process is completed, the container 10 retracts to the outside from the conveyance path. The solid adhesive is supplied to the filler chamber 10*b* from a hopper 38 shown in FIG. 1B according to the liquid amount.

On the other hand, the sheet bundle applied with adhesive is sent to the intersection F by the gripping conveyance means 46, and joined to the covers sheet HS supplied from the cover sheet conveyance path 48. After two are joined, the sheet bundle is bound into a booklet by the folding rollers 53, and if required, a cutting unit 50 arranged at a downstream side of the folding rollers 53 can cut the peripheral edges. The sheet bundle bound with the cover sheet in this way is then stacked and stored in the booklet sheet storing stacker 51.

Note that the cover sheet HS in the embodiment can be printed with a title, etc., at the printing apparatus C and then conveyed out in the same way from the discharge outlet 43, but it is also acceptable to provide an inserter between the printing apparatus C and the bookbinding apparatus A to supply the cover sheet HS from the inserter to the sheet conveyance in path 45. The inserter apparatus can also be composed of a one or a plurality of stacking trays, kick rollers for separating sheets on a tray to single sheets, and of feeding paths that lead sheets from the kick rollers to the sheet conveyance in path 45.

Also, the stacker apparatus D is composed of a discharge tray that sequentially stacks and stores sheets conveyed out from the conveyance outlet 52 of the sheet conveyance out path 49 connected the cover sheet conveyance path 48. In this apparatus, it is acceptable to provide a finishing unit that finishes sheets from the conveyance outlet 52 by stapling, punching holes or by applying a mark. Any known mechanism can be applied as the finishing unit.

This application claims priority rights from Japanese Pat. App. No. 2006-40077, which is herein incorporated by reference.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. An adhesive applicator comprising:

a container for storing hot-melt adhesive;

heating means disposed on the container, for melting to a predetermined temperature solid adhesive filled in the container;

sensor means for detecting the temperature of the adhesive in the container;

temperature control means for controlling the heating temperature of the heating means in response to the temperature detected by the sensor means, the temperature control means being configured to operate in a plurality of heating modes in which the temperature control means controls supplying of power to the heating means at supply levels and supply durations that differ by mode, and being configured to vary the supply of power stepwise, with predetermined mode-dependent delay periods intervening, in each mode in order that the adhesive in the container reach a preestablished temperature; and application means for applying the adhesive in the container to a body of documents; wherein in response to the temperature of the adhesive detected by the sensor means the temperature control means selects a single heating mode from among the plurality of heating modes, and in the selected single heating mode, controls supply of power to the heating means by varying the supply level in time-dependent stages separated by delay periods, until the adhesive in the container reaches the preestablished temperature.

2. An adhesive applicator comprising:

a container for storing hot-melt adhesive;

heating means disposed on the container, for melting to a predetermined temperature solid adhesive filled in the container;

sensor means for detecting the temperature of the adhesive in the container;

temperature control means for controlling the heating temperature of the heating means in response to the temperature detected by the sensor means, the temperature control means being configured to operate in a plurality of heating modes in which the temperature control means controls supplying of power to the heating means at supply levels and supply durations that differ by mode, and being configured to vary the supply of power stepwise, with predetermined mode-dependent delay periods intervening, in each mode in order that the adhesive in the container reach a preestablished temperature; and application means for applying the adhesive in the container to a body of documents; wherein the sensor means is configured with a liquid temperature sensor for directly detecting the temperature of the adhesive within the container, and a heating unit temperature sensor for detecting the temperature of a heating unit disposed in the heating means; and based on the temperature detected by liquid temperature sensor or the heating unit temperature sensor when the applicator is turned on, the temperature control means selects one of the plurality of heating modes, and in the selected heating mode, controls supply of power to the heating means by varying the current level supplied to the heating means in time-dependent stages separated by delay periods, based on the temperature detected by the heating unit temperature sensor, until the adhesive reaches the preestablished temperature.

3. The adhesive applicator according to claim 1, wherein:

the sensor means is configured with a liquid temperature sensor for directly detecting the temperature of the adhesive within the container, and a heating unit temperature sensor for detecting the temperature of a heating unit disposed in the heating means;

the temperature control means selects one of the plurality of heating modes based on the temperature detected by liquid temperature sensor or the heating unit temperature sensor when the applicator is turned on; and the selected heating mode varies the current level supplied to the heating means stepwise, based on the temperature detected by the heating unit temperature sensor, until the adhesive reaches the preestablished temperature.

4. The adhesive applicator according to claim 1, wherein:

a stirring rotor is provided within the container for stirring adhesive inside it; and the stirring rotor is provided with a drive means for rotationally driving the stirring rotor when the sensor means reaches a preestablished, predetermined temperature.

5. The adhesive applicator according to claim 2, wherein:

a stirring rotor is provided within the container for stirring adhesive inside it; and the stirring rotor is provided with a drive means for rotatively driving the stirring rotor when the sensor means reaches a preestablished, predetermined temperature.

6. The adhesive applicator according to claim 4, wherein:

the stirring rotor is constituted by an applicator roller provided in the container;

the drive means is constituted by a reversible drive motor for forward-/reverse-rotating the applicator roller; and the drive motor is controlled to rotationally start when a heating unit temperature sensor for detecting the temperature of the container heating means reaches a predetermined temperature, and to rotate in the opposite direction after a predetermined amount of time has elapsed after the rotational start.

7. The adhesive applicator according to claim 6, wherein:

the applicator roller constituting the stirring rotor rotationally starts after a delay period preestablished by the selected heating mode has elapsed after the sensor means has reached a predetermined temperature; and the preestablished period delays the timing of the rotational start to an extent that the temperature detected by the sensor means is a low temperature when the applicator is turned on.

8. The adhesive applicator according to claim 5, wherein:

the stirring rotor is constituted by an applicator roller provided in the container;

the drive means is constituted by a reversible drive motor for forward-/reverse-rotating the applicator roller; and the drive motor is controlled to rotationally start when a heating unit temperature sensor for detecting the temperature of the container heating means reaches a predetermined temperature, and to rotate in the opposite direction after a predetermined amount of time has elapsed after the rotational start.

9. The adhesive applicator according to claim 8, wherein:

the applicator roller constituting the stirring rotor rotationally starts after a delay period preestablished by the selected heating mode has elapsed after the heating unit temperature sensor has reached a predetermined temperature; and the preestablished period delays the timing of the rotational start to an extent that the temperature detected by the sensor means is a low temperature when the applicator is turned on.

* * * * *